United States Patent [19]

Shinkawa et al.

[11] 4,354,831

[45] Oct. 19, 1982

[54] CRUCIBLE FOR PRECISION CASTING DEVICE

[75] Inventors: Tsutomu Shinkawa, Itami; Hiroaki Tokuda, Yamato, both of Japan

[73] Assignee: Sansha Electric Mfg. Co., Ltd., Osaka, Japan

[21] Appl. No.: 237,998

[22] Filed: Feb. 24, 1981

[30] Foreign Application Priority Data

Feb. 28, 1980 [JP] Japan ..... 55-24838

[51] Int. Cl.[3] ..... F27B 14/10

[52] U.S. Cl. ..... 432/263; 266/275; 373/142; 373/156

[58] Field of Search ..... 432/262, 263; 266/275, 266/276; 13/22, 27; 373/142, 156

[56] References Cited

U.S. PATENT DOCUMENTS 906,117 12/1908 Dewhurst ..... 266/275

3,128,891 4/1964 Schwengel ..... 266/276

*Primary Examiner*—John J. Camby

*Attorney, Agent, or Firm*—Eugene E. Geoffrey, Jr.

[57] ABSTRACT

A crucible used with a precision casting device, especially used for dental purposes, which is vertically or axially divided into a plurality of segments, these segments being held together to form a complete crucible during heating and melting steps and readily released to discharge the contents downwards during casting step.

5 Claims, 6 Drawing Figures

CRUCIBLE FOR PRECISION CASTING DEVICE

Figure 1A:
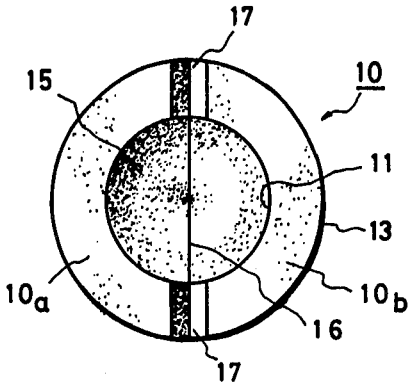
Figure 1B:
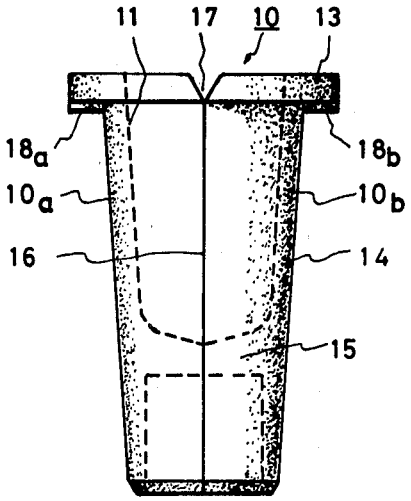
Figure 1C:
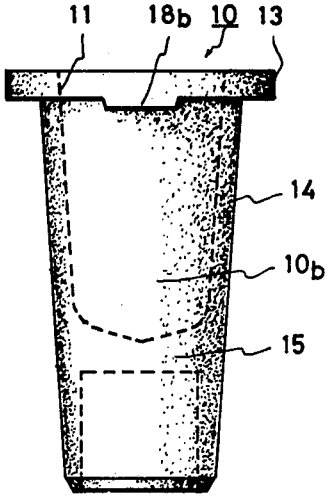
Figure 1D:
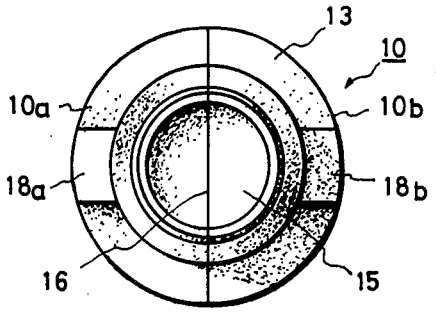

This invention relates to a novel and improved crucible used with a precision casting device, especially, for dental purposes.

Dental precision casting is generally carried out within vacuum or inert atmosphere in order to avoid undesired oxidation and contamination. The process, including melting of material in a crucible and then pouring the melt into a mold is fully carried out within an air-tight sealed chamber of a vacuum casting device, such as described in Japanese Patent Publication No. 52-1235. In this publication, a crucible of conventional cup-shape is used, which is inclined to pour the molten content into a mold. The greatest disadvantage of the cup-shaped inclination-type crucible is the substantial temperature drop of the melt during its travel along the inclined crucible wall, and this results in quality deterioration of the casted product due to an undesirable casting temperature. It has been found, however, that it is also unsuccessful to heat the melt previously up to higher temperatures for compensating for this temperature drop since over-heating may result in an undesirable change of texture. In the case of dental use, the amount of material molten in the crucible is very little, such as several to several-tens of grams, in general. Therefore, loss of material due to deposition onto the crucible wall cannot be made light of, especially, in the case of precious metals. As an improvement, Japanese Patent Publication No. 51-26297 proposed a crucible having a through-hole in the bottom, which is closed by putting a ball thereon. When the material in the crucible is molten, the ball floats up due to difference in specific gravity to discharge the content through the hole. Crucibles having a hole in the bottom, which is closed by a rod-shaped stop, have also been proposed. However, such stops have suffered from the selection of material.

Accordingly, an object of this invention is to provide a novel and improved crucible which needs neither inclination nor a bottom hole for discharging its molten content.

According to the invention, the crucible has a cup-shaped body with a bottom wall, the body being divided vertically into two or more segments which are preferably similar in shape. Each segment has a portion to be supported by a supporting member at its upper part. One of the features of this invention is that the segments are designed and shaped such that, when they are supported by the supporting member, they come apart from each other by their own weights to form an aperture in the bottom. The segments are gathered and held together at their lower portions by a holding member to form a complete crucible during the step of melting material, and are released for discharging the content into a mold located downwards.

These and other objects and features of this invention will be described hereinunder in more detail with reference to the accompanying drawings and in conjunction with a preferred embodiment.

IN THE DRAWINGS

Figure 2:
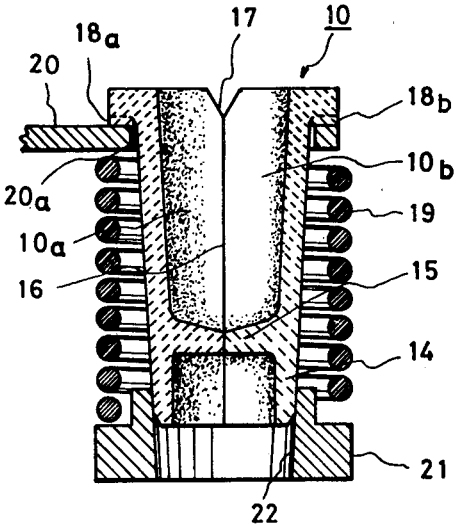
Figure 2:
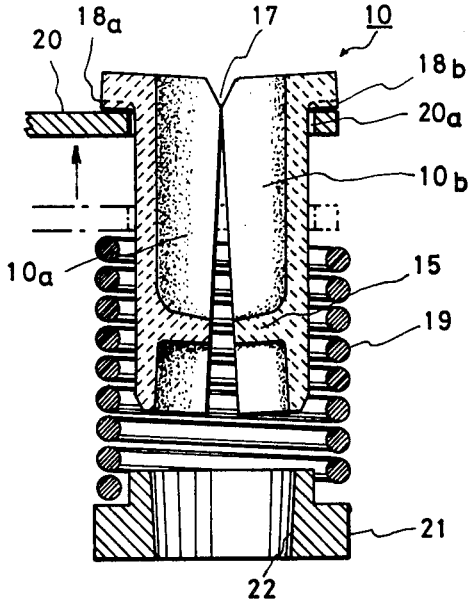

FIGS. 1 (*a*), (*b*), (*c*) and (*d*) are top plan view, front view, side view and bottom plan view, respectively, of an embodiment of a crucible according to this invention; and FIGS. 2 (*a*) and (*b*)are vertical sectional views representing two states of operation of the inventive crucible as shown in FIG. 1.

Referring to FIG. 1, the crucible according to this invention is denoted generally by the numeral 10 and comprised of a tapered cylindrical body having an aperture 11 at the top which is surrounded by a flange 13, a cylindrical side wall 14 and a bottom wall 15 located at a lower portion of the side wall. The body is divided by a vertical plane 16 into two similar segments 10*a* and 10*b*. The upper corners 17 of the segments 10*a* and 10*b* along the cut plane 16 are cut away obliquely to form V-shaped slots, as shown. The segments 10*a* and 10*b* have projections 18*a* and 18*b*, respectively, on the lower face of the flange 13, the function of which will be described later.

In operation, the crucible 10 is surrounded by a heating element 19, such as a resistive winding or RF induction coil, as shown in FIG. 2(*a*). A supporting member 20 is provided for supporting the crucible in its aperture 20*a* at the projections 18*a* and 18*b*. The lower end of the crucible 10 is inserted in an aperture 22 of a holding member 21 which holds the segments 10*a* and 10*b* tightly together as an integral body. In this state, a material to be melted is loaded in the crucible and then melted by energizing the heating element 19. Even if a slight gap exists along the cut plane 16, surface tension of the melt will prevent its flowing out through the gap. Though not shown in the drawing, a suitable mold is placed under the crucible 10 so that the pouring gate of the mold is located on the central axis of the crucible.

When the material is molten and heated up to a predetermined casting temperature, (the supporting member 20 is raised as shown by an arrow in FIG. 2(*b*) together with the crucible 10 the original location of the supporting member 20 being shown in broken lines). Thus, the lower end of the crucible is released from the holding member 21 and the segments 10*a* and 10*b* come apart from each other at their lower ends by their own weights, thereby discharging the contents downwardly. As readily understood, the movement of the segments is due to deviation of their centers of gravity from the supporting points of the projections 18*a* and 18*b*.

The V-shaped cuts 17 serve to facilitate the opening of the segments 10*a* and 10*b* and the amount of this opening depends upon the depth of the V-cuts 17. By adequately selecting the depth and angle of the V-cuts 17, the segments 10*a* and 10*b* can be balanced in the state of FIG. 2(*b*) without escaping from the supporting member 20. In order to prevent excessive movement and resultant escaping of the segments 10*a* and 10*b* from the supporting member 20, suitable stopper means may be provided, or the heating element 19 may be utilized as the stopper means.

With the crucible according to this invention, the molten material in the crucible is discharged directly into the mold without any contact with other materials. Accordingly, there will be little change in temperature of melt and no chance of loss of material.

It should be noted that the above description has been made only in conjunction with one embodiment and various modifications and changes can be made within the scope of this invention. For example, for the purpose of releasing the lower ends of the crucible segments from the holding member 21, the holding member 21 may be pulled down instead of raising the supporting member 20. Alternatively, the holding member 21 may be designed so as to pull the lower end of each segments horizontally from the other to open them.

Moreover, many variations of design of the supporting structure between the crucible and the supporting member 20 can be proposed. For example, supporting projections as 18*a* and 18*b* may be provided on the upper face of the supporting member 20 instead of the lower face of the flange 13. The supporting portion of the crucible may be a part of the side wall 14 instead of the flange 13, or may be formed on or in the side wall 14.

Furthermore, the crucible may be divided into three or more segments instead of two, as occasion demands. These and other variations are within the scope of this invention as defined by the appended claims.

What is claimed is:

1. A crucible having a tubular body with a bottom wall, said body and bottom wall being divided vertically into a plurality of segments, each of said segments having a support portion to be supported by supporting means at its upper part and a center of gravity deviating horizontally from said support portion, and at least one top corner of each segment having an oblique tapered portion on the dividing plane whereby the lower ends of said segments come apart when the segments are hung at said support portion.

2. A crucible having a tubular body with a bottom wall, said body and bottom wall being divided vertically into a plurality of segments, each of said segments having a support portion to be supported by supporting means at its upper part and a center of gravity deviating horizontally from said support portion, whereby the lower ends of said segments come apart when the segments are hung at said support portion, each of said segments having an oblique cut-away at each top corner on the dividing plane.

3. A crucible having a tubular body with a bottom wall, said body and bottom wall being divided vertically into a plurality of segments, each of said segments having a support portion to be supported by supporting means at its upper part and a center of gravity deviating horizontally from said support portion, whereby the lower ends of said segments come apart when the segments are hung at said support portion, each of said segments having a flange at the top as said support portion and a projection is formed on the lower face of said flange.

4. A crucible supporting device for use with a crucible according to claims 1, 2 or 3 wherein said supporting device comprises a supporting member having an upper face for supporting said support portions of said segments, a holding member for holding the lower ends of said segments together to form a tight crucible, and means for releasing the holding state of said holding member with respect to said segments to permit the lower ends of said segments to separate one from the other for the discharge of the contents thereof.

5. A crucible according to claim 1 wherein said support portion comprises an element projecting from the upper portion of each of said segments for pivotally engaging cooperating supporting means.

* * * * *